US011208885B2

(12) United States Patent
Stokely et al.

(10) Patent No.: US 11,208,885 B2
(45) Date of Patent: Dec. 28, 2021

(54) METHOD AND SYSTEM TO CONDUCT MEASUREMENT WHILE CEMENTING

(71) Applicant: HALLIBURTON ENERGY SERVICES, INC., Houston, TX (US)

(72) Inventors: Christopher Lee Stokely, Houston, TX (US); John Laureto Maida, Jr., Houston, TX (US); Krishna M. Ravi, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/071,839

(22) Filed: Oct. 15, 2020

(65) Prior Publication Data

US 2021/0238995 A1 Aug. 5, 2021

Related U.S. Application Data

(60) Provisional application No. 62/968,980, filed on Jan. 31, 2020, provisional application No. 62/969,015, filed on Jan. 31, 2020.

(51) Int. Cl.
*E21B 33/16* (2006.01)
*E21B 47/135* (2012.01)
(Continued)

(52) U.S. Cl.
CPC ..... *E21B 47/135* (2020.05); *E21B 23/10* (2013.01); *E21B 33/16* (2013.01); *E21B 33/165* (2020.05); *E21B 47/10* (2013.01); *E21B 23/14* (2013.01)

(58) Field of Classification Search
CPC ..... E21B 33/16; E21B 33/165; E21B 47/09; E21B 47/10
See application file for complete search history.

(56) References Cited

U.S. PATENT DOCUMENTS 8,305,228 B2 11/2012 Vigneaux
8,408,064 B2 4/2013 Hartog et al.
(Continued)

FOREIGN PATENT DOCUMENTS

CN 104975847 B 6/2017
WO 2014099066 A1 6/2014
WO 2016186612 A1 11/2016

OTHER PUBLICATIONS

International Search Report and Written Opinion for International application No. PCT/US2020/059414, dated Feb. 24, 2021, 11 pages.

*Primary Examiner* — Giovanna Wright
(74) *Attorney, Agent, or Firm* — Polsinelli PC

(57) ABSTRACT

A system for cementing a wellbore having a casing string disposed in the wellbore is provided. The system includes a cement tool, a fiber optic cable, and a computing device. The cement tool is operable to be deployed down the wellbore through a casing string from a surface during cementing process of the wellbore. The cement tool includes a tool sensor. The fiber optic cable is coupled with the cement tool such that the fiber optic cable spans the wellbore from the cement tool to the surface. The fiber optic cable is communicatively coupled with the tool sensor. The computing device is communicatively coupled with the fiber optic cable and is operable to receive and process signals from the tool sensor via the fiber optic cable during the cementing process.

14 Claims, 8 Drawing Sheets

(51) Int. Cl.

| | |
|---|---|
| ***E21B 47/10*** | (2012.01) |
| ***E21B 23/10*** | (2006.01) |
| *E21B 23/14* | (2006.01) |

(56) References Cited

U.S. PATENT DOCUMENTS

| | | | | |
|---|---|---|---|---|
| 2002/0157828 | A1* | 10/2002 | King | E21B 47/12 166/285 |
| 2004/0060697 | A1* | 4/2004 | Tilton | E21B 47/09 166/253.1 |
| 2008/0272931 | A1 | 11/2008 | Auzerais et al. | |
| 2009/0145601 | A1* | 6/2009 | Bailey | E21B 17/028 166/250.04 |
| 2013/0021874 | A1 | 1/2013 | Hartog et al. | |
| 2014/0034301 | A1 | 2/2014 | Leblanc | |
| 2015/0330214 | A1 | 11/2015 | Duphorne | |
| 2018/0238139 | A1 | 8/2018 | Gao et al. | |
| 2018/0313206 | A1* | 11/2018 | Dirksen | E21B 17/003 |

* cited by examiner

METHOD AND SYSTEM TO CONDUCT MEASUREMENT WHILE CEMENTING

CROSS-REFERENCE TO RELATED APPLICATIONS

This application claims the benefit of U.S. Provisional Patent Application No. 62/968,980, filed in the U.S. Patent and Trademark Office on Jan. 31, 2020, and U.S. Provisional Patent Application No. 62/969,015, filed in the U.S. Patent and Trademark Office on Jan. 31, 2020, each of which is incorporated herein by reference in its entirety for all purposes.

FIELD

The present disclosure relates generally to a system and method to conduct measurement while cementing. In at least one example, the present disclosure relates to a system and method to utilize a fiber optic cable to transmit signals from a tool sensor while cementing.

BACKGROUND

Wellbores are drilled into the earth for a variety of purposes including tapping into hydrocarbon bearing formations to extract the hydrocarbons for use as fuel, lubricants, chemical production, and other purposes.

During completion of the wellbore, the annular space between the wellbore wall and a casing string (or casing) can be filled with cement. This process can be referred to as "cementing" the wellbore. A lower plug can be inserted into the casing string after which cement can be pumped into the casing string. An upper plug can be inserted into the wellbore after a desired amount of cement has been injected. The upper plug, the cement, and the lower plug can be forced downhole by injecting displacement fluid into the casing string. Receiving measurements during cementing can prevent damage to the well or other errors in the cementing process. Improving the cement casing can increase the integrity of the well.

BRIEF DESCRIPTION OF THE DRAWINGS

Implementations of the present technology will now be described, by way of example only, with reference to the attached figures, wherein.

DETAILED DESCRIPTION

Figure 1:
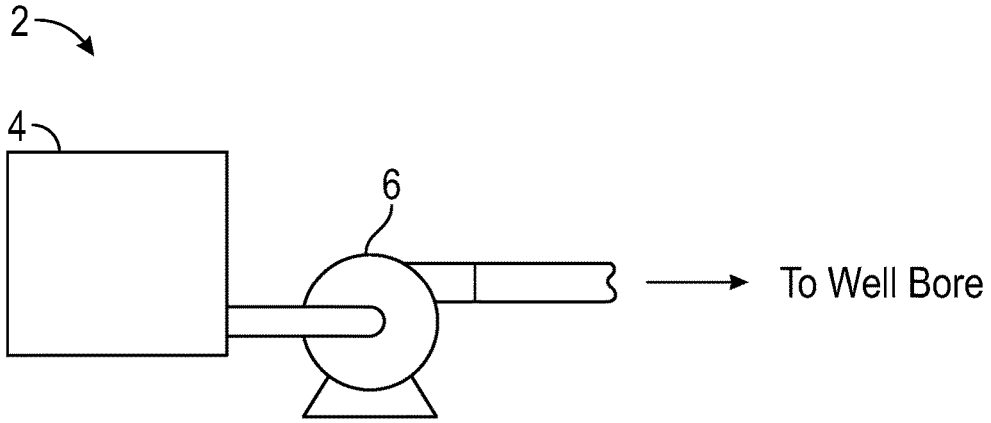
FIG. 1 illustrates a diagram of a system for preparation and delivery of a cement composition to a wellbore in accordance with aspects of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the examples described herein. The drawings are not necessarily to scale and the proportions of certain parts may be exaggerated to better illustrate details and features of the present disclosure.

This disclosure includes deployment of a fiber optic cable into a wellbore during a cementing process. The fiber optic cable is deployed into the wellbore, for example in a casing string, by a cement tool. The cement tool can include, for example, a cement plug and/or a dart. In at least one example, the cement tool can be utilized to displace cement into the annulus of the wellbore as the cement tool is pushed down the wellbore. In some examples, the cement tool is forced down the wellbore by injection of displacement fluid from the surface. The fiber optic cable can be coupled with the cement tool, and as the cement tool moves down the wellbore, the fiber optic cable is deployed. Accordingly, the fiber optic cable can span the wellbore from the surface to the cement tool.

The cement tool can include a tool sensor. In at least one example, the tool sensor can include a chemical sensor operable to measure chemical properties of the wellbore during the cementing process. For example, the chemical sensor can measure gas influx and/or water influx. In at least one example, the chemical sensor can measure methane influx which can present problems during the cementing process.

In at least one example, the tool sensor can include a cement sensor operable to determine the presence of cement. For example, the cement tool may include sealing portions which creates a seal across the casing string such that the cement tool can push the cement down the wellbore while maintaining separation between the cement and the displacement fluid. The cement sensor can determine whether the sealing portions are functioning properly and maintaining the seal by determining whether there is greater than a threshold amount of cement uphole of the sealing portions where cement should not be present—for example where only displacement fluid should be present. In at least one example, the cement sensor can be positioned uphole of the sealing portions.

The tool sensor can be communicatively coupled with the fiber optic cable such that a computing device can receive signals from the tool sensor via the fiber optic cable. The computing device can be, for example, at the surface. The computing device can then process the signals received from the tool sensor, and the cementing process can be adjusted as needed.

The fiber optic cable can survive over great distances, such as several thousand feet, in the wellbore despite abrasion due to sand-laden drilling mud, chemical effects, pressure effects, and the drag on the fiber optic cable due to mud flow down the casing string. Accordingly, the deployment of the fiber optic cable utilizes the single trip down the wellbore with a cement tool to be able to monitor the wellbore and the cementing process during the cementing process with less cost and less complexity.

The exemplary cement compositions disclosed herein may directly or indirectly affect one or more components or pieces of equipment associated with the preparation, delivery, recapture, recycling, reuse, and/or disposal of the disclosed cement compositions. For example, the disclosed cement compositions may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the exemplary cement compositions. The disclosed cement compositions may also directly or indirectly affect any transport or delivery equipment used to convey the cement compositions to a well site or downhole such as, for example, any transport vessels, conduits, pipelines, trucks, tubulars, and/or pipes used to compositionally move the cement compositions from one location to another, any pumps, compressors, or motors (e.g., topside or downhole) used to drive the cement compositions into motion, any valves or related joints used to regulate the pressure or flow rate of the cement compositions, and any sensors (i.e., pressure and temperature), gauges, and/or combinations thereof, and the like. The disclosed cement compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Referring now to FIG. 1, a system 2 may be used in the preparation of a cement composition. FIG. 1 illustrates the system 2 for preparation of a cement composition and delivery to a wellbore in accordance with certain examples. As shown, the cement composition may be mixed in mixing equipment 4, such as a jet mixer, re-circulating mixer, and/or a batch mixer, for example, and then pumped via pumping equipment 6 to the wellbore. In some examples, the mixing equipment 4 and the pumping equipment 6 may be disposed on one or more cement trucks. In some examples, a jet mixer may be used, for example, to continuously mix the composition, including water, as the cement composition is being pumped to the wellbore.

Figure 2A:
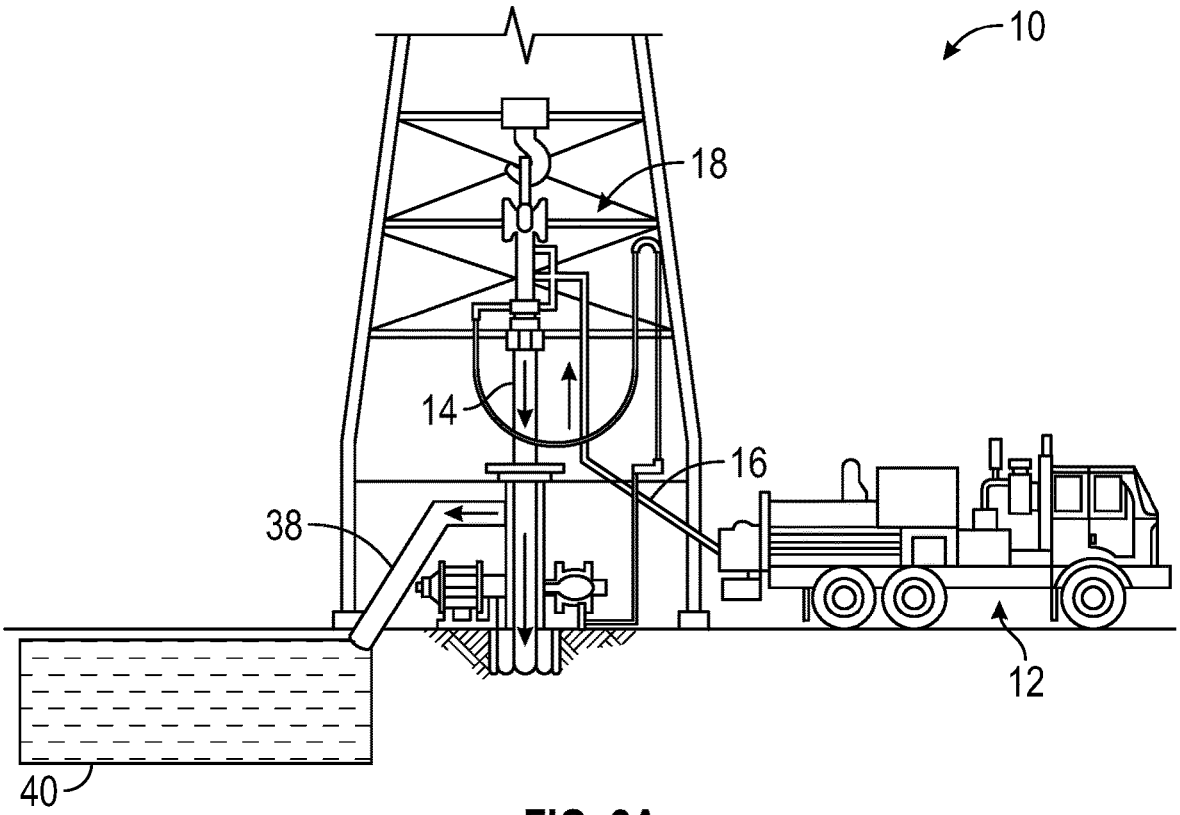
FIG. 2A illustrates a diagram of surface equipment that may be used in placement of a cement composition in a wellbore in accordance with aspects of the present disclosure.
Figure 2B:
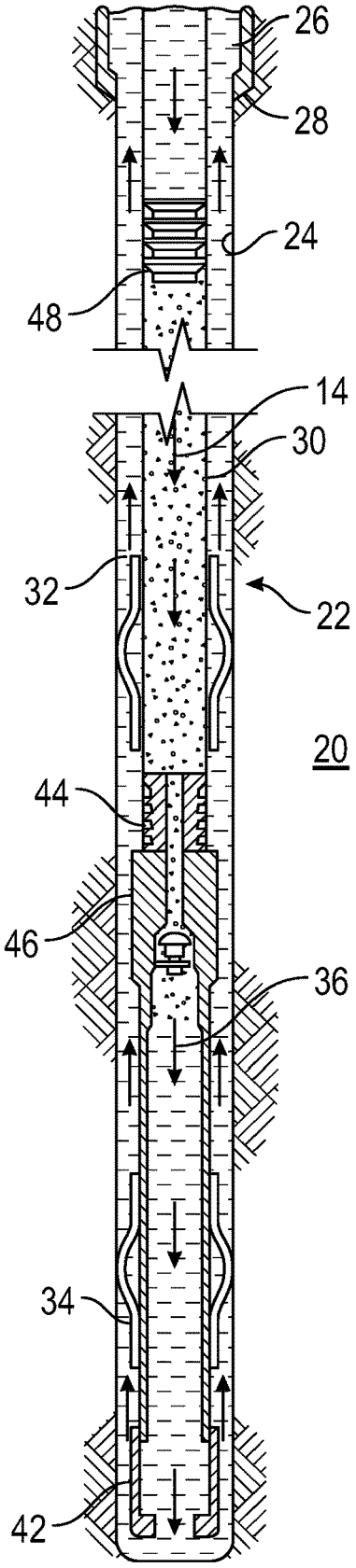
FIG. 2B illustrates a diagram of placement of a cement composition into a wellbore annulus in accordance with aspects of the present disclosure.

An example technique and system for placing a cement composition into a subterranean formation is illustrated in FIGS. 2A and 2B. FIG. 2A illustrates surface equipment 10 that may be used in placement of a cement composition in accordance with certain examples. It should be noted that while FIG. 2A generally depicts a land-based operation, those skilled in the art will readily recognize that the principles described herein are equally applicable to subsea operations that employ floating and/or sea-based platforms and rigs, without departing from the scope of the disclosure.

As illustrated by FIG. 2A, the surface equipment 10 may include a cementing unit 12, which may include one or more cement trucks. The cementing unit 12 may include mixing equipment 4 and/or pumping equipment 6 (for example as shown in FIG. 1). The cementing unit 12 may pump a cement composition 14 through a feed pipe 16 and to a cementing head 18 which conveys the cement composition 14 downhole.

Turning now to FIG. 2B, the cement composition 14 may be placed into a subterranean formation 20 in accordance with the disclosure herein. As illustrated, a wellbore 22 may be drilled into the subterranean formation 20. While wellbore 22 is shown extending generally vertically into the subterranean formation 20, the principles described herein are also applicable to wellbores that extend at an angle through the subterranean formation 20, such as horizontal, slanted, and/or multilateral wellbores. As illustrated, the wellbore 22 comprises walls 24. In the illustrated examples, a surface casing 26 has been inserted into the wellbore 22. The surface casing 26 may be cemented to the walls 24 of the wellbore 22, for example by cement sheath 28. In the illustrated example, one or more additional conduits (for example, intermediate casing, production casing, liners, etc.) shown here as casing string 30 may also be disposed in the wellbore 22. As illustrated, a wellbore annulus 32 can be formed between the casing string 30 and the walls 24 of the wellbore 22 and/or the surface casing 26. In at least one example, one or more centralizers 34 may be attached to the casing string 30, for example, to maintain the position of the casing string 30 in the wellbore 22 prior to and/or during the cementing operation. For example, the centralizers 34 may position the casing string 30 substantially in the center of the wellbore 22.

With continued reference to FIG. 2B, the cement composition 14 may be pumped down the interior of the casing string 30. The cement composition 14 may be allowed to flow down the interior of the casing string 30 through the casing shoe 42 at the bottom of the casing string 30 and up around the casing string 30 into the wellbore annulus 32. The cement composition 14 may be allowed to set in the wellbore annulus 32, for example, to form a cement sheath that supports and positions the casing string 30 in the wellbore 22. While not illustrated, other techniques may also be utilized for introduction of the cement composition 14. By way of example, reverse circulation techniques may be used that include introducing the cement composition 14 into the subterranean formation 20 by way of the wellbore annulus 32 instead of through the casing string 30.

As the cement composition 14 is introduced into the wellbore 22, the cement composition 14 may displace other fluids 36, such as drilling fluids and/or spacer fluids, that may be present in the interior of the casing string 30 and/or the wellbore annulus 32. At least a portion of the displaced fluids 36 may exit the wellbore annulus 32 via a flow line 38 and be deposited, for example, in one or more retention pits 40 (for example, a mud pit), as shown on FIG. 2A. Referring again to FIG. 2B, a bottom plug 44 may be introduced into the wellbore 22 ahead of the cement composition 14, for example, to separate the cement composition 14 from the fluids 36 that may be inside the casing string 30 prior to cementing. After the bottom plug 44 reaches the landing collar 46, a diaphragm or other suitable device ruptures to allow the cement composition 14 through the bottom plug 44. In FIG. 2B, the bottom plug 44 is shown on the landing collar 46. In the illustrated example, a top plug 48 may be introduced into the wellbore 22 behind the cement composition 14. The top plug 48 may separate the cement composition 14 from a displacement fluid 50 and also push the cement composition 14 through the bottom plug 44.

Figure 3A:
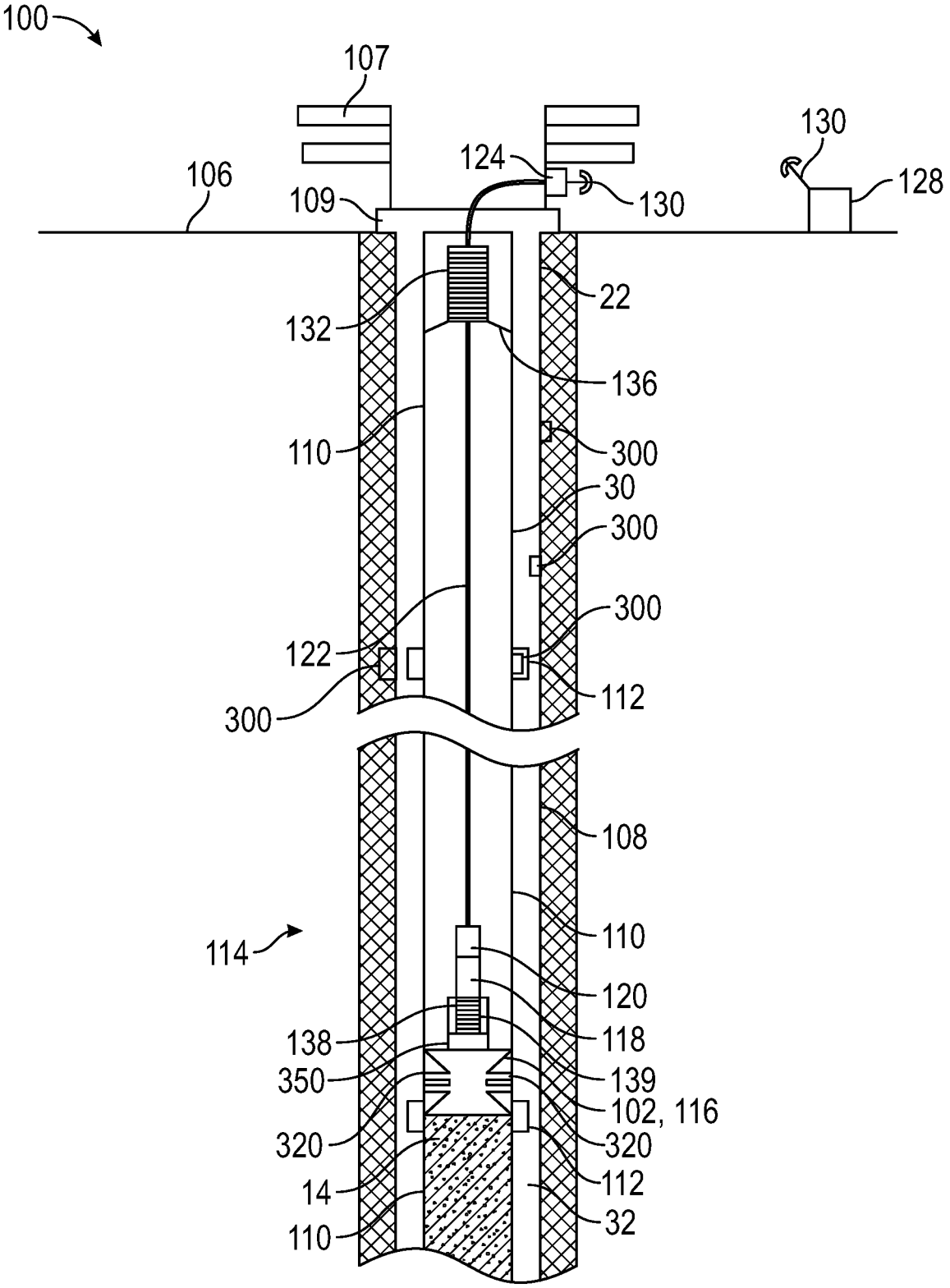
FIG. 3A illustrates a diagram of a system deploying a cementing device including a fiber optic cable using a cement tool.
Figure 3B:
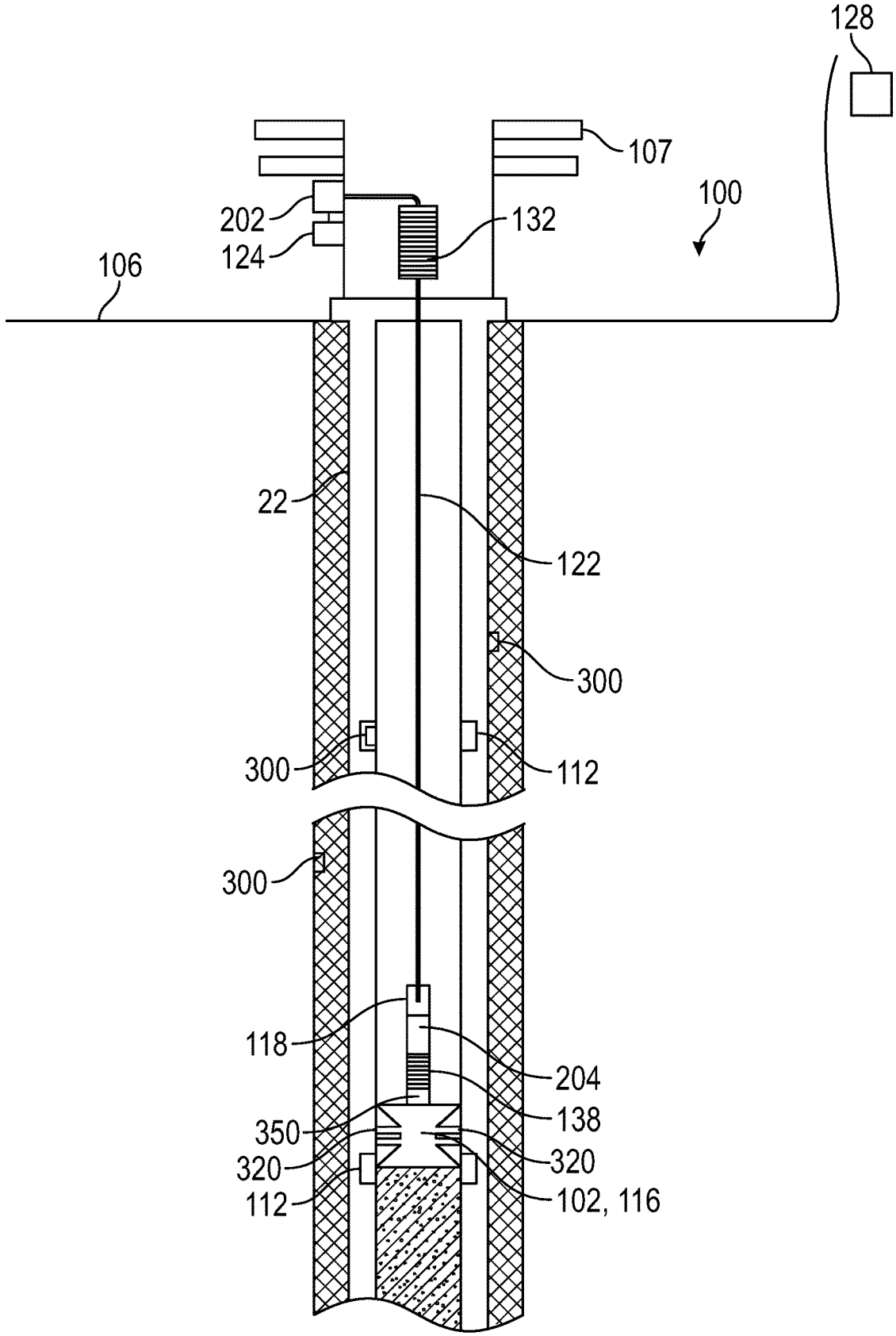
FIG. 3B illustrates a diagram of another example of a system deploying a cementing device including a fiber optic cable using a cement tool.
Figure 3C:
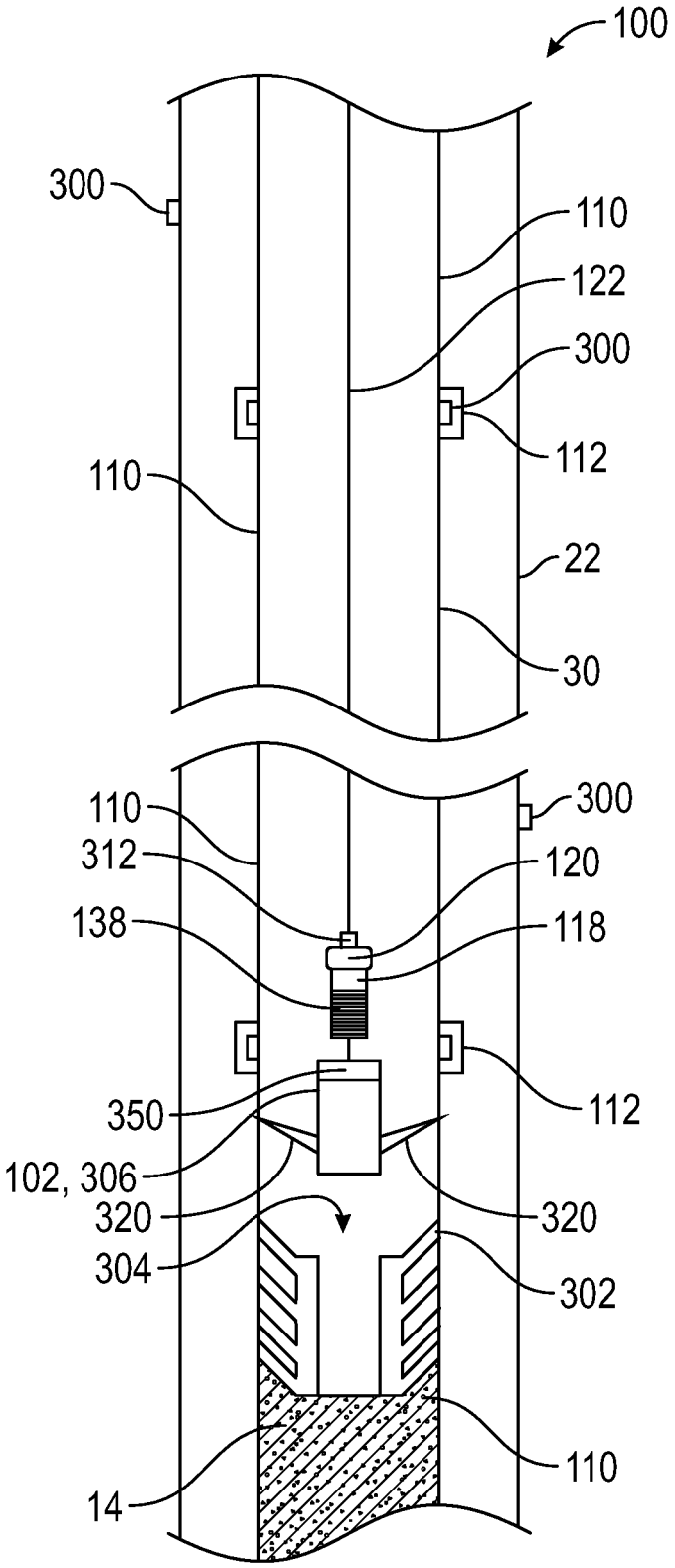
FIG. 3C illustrates a diagram of another example of a system deploying a cementing device including a fiber optic cable using a cement tool.

A fiber optic cable can be deployed in the wellbore 22 during cementing. FIGS. 3A-3C illustrate examples of deployment of cementing device which can include a fiber optic cable and a cement tool 102 such as a cement plug 116 (shown in FIGS. 3A and 3B) and/or a dart 306 (shown in FIG. 3C). The cement tool 102 can be utilized to displace cement 14 into the annulus 32 of the wellbore 22 as the cement tool 102 is pushed down the wellbore 22.

As illustrated in FIGS. 3A and 3B, a cement tool 102, for example a cement plug 116, can be deployed and positioned downhole in the casing string 30. In some examples as illustrated in FIG. 3A, the casing string 30 can include multiple casing tubes 110 coupled together end-to-end by casing collars 112. A blowout preventer 107 ("BOP") can be positioned above a wellhead 109 at the surface 106.

The cement plug 116 can be an upper cement plug that is inserted into the casing string 30 after a desired amount of cement 14 has been injected into the casing string 30. In some examples, a dart (for example as shown in FIG. 3C) for plugging a cement plug can be used in place of the cement plug 116. The cement plug 116 can be forced downhole by the injection of displacement fluid from the surface 106. A lower cement plug can be positioned below cement 14 and can be forced downhole until it rests on a floating collar at the bottom of the casing string 30. In at least one example, the cement plug 116 can be forced down the wellbore 22 until it contacts the lower cement plug. In some examples, the cement plug 116 can force the cement 14 down wellbore 22 until the cement plug 116 ruptures the lower cement plug and is forced out of a shoe of the casing string 30. The cement 14 can flow out of the casing string 30 and into the annulus 32 of the wellbore 22.

In at least one example, as illustrated in FIGS. 3A and 3B, the cement plug 116 can abut the walls of the casing string 30 such that the cement plug 116 substantially creates a seal against the walls of the casing string 30. The cement plug 116 can include one or more sealing portions 320 which extend radially from a body of the cement plug 116. The sealing portions 320 can be operable to create the seal against the casing string 30 and/or the wellbore 22. Accordingly, cement does not pass across the cement plug 116 as the cement plug 116 pushes the cement or any other fluid down the casing string 30 and/or the wellbore 22. Also, the cement plug 116 creating the seal permits the displacement fluid to efficiently and more forcefully push the cement plug 116 down the casing string 30 and/or the wellbore 22.

A fiber optic cable 122 can be coupled to the cement plug 116 and traverse the wellbore 22 from the surface 106 to the location of the cement plug 116. A light source, for example LED 120, communicatively coupled with the fiber optic cable 122 can emit a pulse of light (e.g., an optical signal). The LED 120 can transmit the pulse of light to a receiver 124 positioned the surface 106. In some examples, the LED 120 can operate at a 1300 nm wavelength can minimize Rayleigh transmission losses and hydrogen-induced and coil bend-induced optical power losses. In some examples, high speed laser diode or other optical sources can be used in place of the LED 120 and various other optical wavelengths can be used. For example, wavelengths from about 850 nm to 5100 nm can make use of the optical low-transmission wavelength bands in ordinary fused silica multimode and single mode fibers.

The pulse of light generated by the LED 120 can be transmitted to the receiver positioned at the surface 106 using the fiber optic cable 122. The receiver 124 can be an optical receiver, for example a photodetector that can convert the optical signal into electricity.

In some examples, the receiver 124 can be communicatively coupled to a computing device 128 by a communication link 130. The communication link 130 can include a wireless communication link. The communication link 130 can include wireless interfaces such as IEEE 802.11, Bluetooth, and/or radio interfaces for accessing cellular telephone networks (e.g., transceiver/antenna for accessing a CDMA, GSM, UMTS, and/or other mobile communications network). In some examples, the communication link 130 may be wired. A wired communication link can include interfaces such as Ethernet, USB, IEEE 1394, and/or a fiber optic interface. The receiver 124 can transmit information related to the optical signal, for example but not limited to the light pulse count, the time the light pulse arrived, or other information, to the computing device 128. In some examples, the receiver 124 can be coupled to a transmitter that communicates with the computing device 128.

In at least one example, the receiver 124 can transmit information to a computing device 118 communicatively coupled to the fiber optic cable 122 opposite the receiver 124 via the fiber optic cable 122. The computing device 118 can receive and/or demodulate optical signals received through the fiber optic cable 122 from the receiver 124. In some examples, the computing device 118 can be disposed adjacent to the cement plug 116. In some examples, the computing device 118 can be in communication with and/or control sensors, motors, or any other suitable downhole device. For example, the receiver 124 may transmit an optical signal via the fiber optic cable 122, and the computing device 118 may receive and demodulate the signal to open a valve in a downhole device.

In at least one example, the fiber optic cable 122 that transmits the light pulse to from the LED 120 to receiver 124 can include an unarmored fiber. The unarmored fiber can include a fiber core and cladding but no outer buffer. In some examples, the fiber optic cable 122 can include an armored fiber. The armored fiber can include a fiber core, a cladding, and an outer buffer. The inclusion of the outer buffer can increase the diameter of the fiber optic cable. The fiber optic cable 122 can be a multi-mode or single-mode optical fiber. The fiber optic cable can include one or more optical fibers. The fiber optic cable 122 can be a sacrificial cable that is not retrieved from the wellbore 22 but instead remains in the wellbore 22 until it destroyed. For example, the fiber optic cable 122 can be destroyed during stimulation of the wellbore 22.

The fiber optic cable 122 can be dispensed from an upper bobbin or reel 132 positioned within the wellbore 22 proximate to the surface 106 as the cement plug 116 is forced downhole. In some examples, the upper reel 132 can be positioned at or adjacent to the surface 106, for example proximate to the blowout preventer 107. In some examples, the upper reel 132 can be secured within the wellbore 22 by a securing device, for example by spring loaded camming feet 136 or other suitable securing mechanisms. The upper reel 132 can have a zero tension payout that can dispense the fiber optic cable 122 when there is a tension in the fiber optic cable 122.

The fiber optic cable 122 can be tensioned by and pulled along with the displacement fluid being injected into the casing string 30 to move the cement plug 116 down the wellbore 22. The upper reel 132 can dispense additional lengths of the fiber optic cable 122 as the fiber optic cable 122 is tensioned by the displacement fluid injected into the wellbore 22. In some examples, the fiber optic cable 122 can spool off the upper reel 132 at the same rate as the flow of the displacement fluid. The upper reel 132 can prevent the fiber optic cable from breaking or otherwise becoming damaged as the fiber optic cable 122 and the plug 116 travel downhole.

In some examples, the fiber optic cable 122 can also be spooled on and dispensed from a lower bobbin or reel 138 positioned proximate to the cement plug 116. The lower reel 138 can include a drag device 139. The drag device 139 can allow the lower reel 138 to dispense the fiber optic cable 122 when a pre-set tension in the fiber optic cable 122 is reached. The lower reel 138 can prevent the fiber optic cable from breaking or otherwise becoming damaged as the fiber optic cable 122 and the cement plug 116 travel down the wellbore 22. The upper reel 132 and the lower reel 138 can store greater lengths of unarmored fiber optic cable than armored fiber optic cable. While FIG. 3A depicts the lower reel 138 positioned below the LED 120 and the computing device 118, In some examples the lower reel 138 can be positioned elsewhere with respect to the LED 120 and the computing device 118.

The fiber optic cable 122 can be dispensed from the upper reel 132 and/or the lower reel 138 in response to the tension in the fiber optic cable 122 increasing above a pre-set limit. The upper reel 132 and/or the lower reel 138 can have a zero tension payout that releases additional lengths of fiber optic cable 122 when the tension in the fiber optic cable 122 increases beyond zero. In some examples in which an upper reel 132 and a lower reel 138 are both used, the shared fiber payout can minimize potential fiber over tension or fiber damage from chaffing against the wellbore or a tubing string. For example, the wellbore 22 can include a bent or highly deviated heel or can curve and become horizontal. The upper reel 132 and the lower reel 138 can prevent the fiber optic cable 122 from breaking, chaffing, or otherwise becoming damaged as the cement plug 116 and fiber optic cable 122 are forced around a curve into a horizontal or lateral portion of the wellbore.

In some examples, the fiber optic cable 122 can be actively dispensed from the upper reel 132 and/or a lower reel 138 by a motor. In some examples, one or both of the upper reel 132 and the lower reel 138 can utilize soft high-temperature rated polymer cements or binders to hold the fiber optic cable 122 turns together around the reel. As the fiber optic cable 122 spooled on the applicable reel is dispensed by the increased tension in the cable, the fiber optic cable 122 can be peeled from the outermost layer of the applicable reel.

FIG. 3B is a schematic diagram of another example of a well system 100 including a light source that includes a laser 202. The laser 202 can be positioned at the surface 106 proximate to the BOP 107. The laser 202 can be coupled to the fiber optic cable 122 which can be dispensed at an end by the upper reel 132. The upper reel 132 can be positioned at the surface 106 proximate to the BOP 107. In some examples, the laser 202 and the upper reel 132 can be positioned elsewhere at the surface 106 or within the wellbore 22.

The laser 202 can be a high repetition pulse laser or other suitable light source. The laser 202 can generate an optical signal, for example, a series of light pulses that are transmitted by the fiber optic cable 122. The cement plug 116 can be coupled to the lower reel 138 and the computing device 118. In some examples, the computing device 118 can include and/or be coupled to a modulation device. The modulation device can be, for example but not limited to, a pendulum switch 204. The pendulum switch 204 can include a mirror that can be shifted between two positions.

The optical signal generated by the laser 202 can travel the length of the fiber optic cable 122 and reach a lower end of the fiber optic cable 122 proximate to the lower reel 138. The pendulum switch 204 can be positioned proximate to the lower end of the fiber optic cable 122. The pendulum switch 204 can modulate the optical signal (e.g., pulses of light) generated by the laser 202. In some examples, a piezoelectric sensor, or another suitable modulation device can be used to modulate the optical signal of the laser 202. In some examples, the modulation device can modulate, for example but not limited to, the frequency, amplitude, phase, or other suitable characteristic of the optical signal.

In some examples, the pendulum switch 204 can include a mirror. The position of the mirror of the pendulum switch 204 can be controlled by the computing device 118. The mirror of the pendulum switch 204 can have two positions. In a first position, the mirror of the pendulum switch 204 can reflect the pulse of light arriving at the lower end of the fiber optic cable 122 away from the fiber optic cable 122. The pulse of light can fail to be re-transmitted to the receiver 124 via the fiber optic cable 122. In a second position, the mirror of the pendulum switch 204 can reflect the pulse of light arriving at the lower end of the fiber optic cable 122 back into the fiber optic cable 122. The pulse of light can be re-transmitted to the receiver 124 via the fiber optic cable 122. The position of the mirror of the pendulum switch 204 can be controlled by the computing device 118.

The receiver 124 disposed at or near the surface 106 can monitor the light pulses transmitted along the fiber optic cable 122. The receiver 124 can detect when a pulse of light transmitted by the laser 202 is not returned to the receiver 124 via the fiber optic cable 122. The pulse of light that is transmitted downhole by the laser 202 but not transmitted back to the surface 106 can indicate the pendulum switch 204 reflected the light pulse away from the fiber optic cable 122. In some examples, the receiver 124 can transmit information regarding the light pulses to the computing device 128. In some examples, the receiver 124 can include an interferometer. In some examples, the interferometer can determine the phase of the optical signal.

FIG. 3C is a schematic diagram of another example of a well system 100 where the cement device 102 includes a dart 306. A cement plug 302 having an opening 304 can be lowered into the wellbore 22 within the casing tube 110 of the casing string 30. The cement 14 can be pumped into the wellbore 22 and can pass through the opening 304 of the cement plug 302. After the desired amount of cement 14 has been pumped into the wellbore 22 a cementing device 102, for example a dart 306, can be launched from the surface to dock with and seal the opening 304. The dart 306 can be forced downhole by the injection of the displacement fluid from the surface.

Figure 4A:
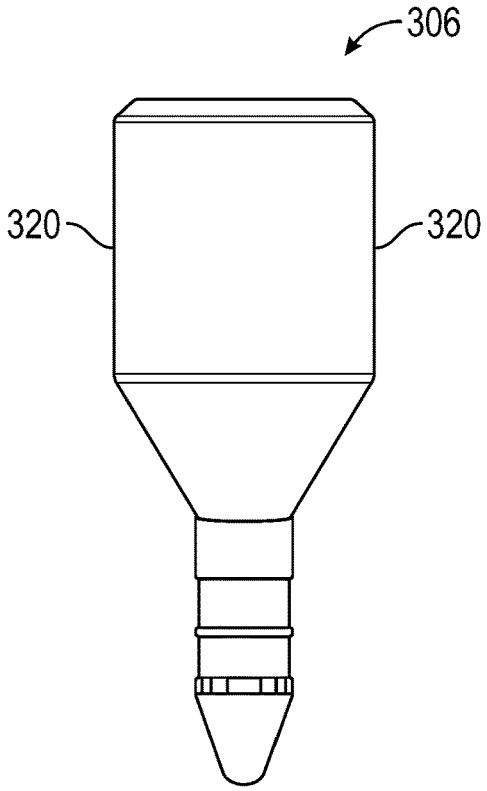
FIG. 4A illustrates a diagram of a dart.
Figure 4B:
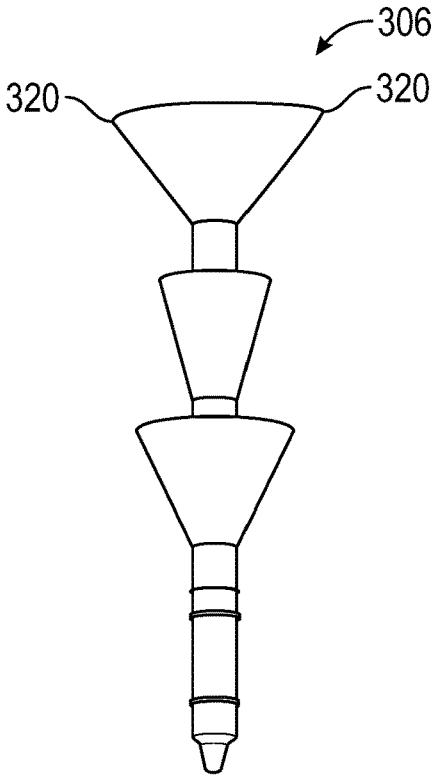
FIG. 4B illustrates a diagram of another example of a dart.

FIGS. 4A and 4B illustrate examples of a dart 306. The dart 306 is configured to be utilized during a cementing process. In at least one example, the dart 306 can abut the walls of the casing string 30 such that the dart 306 substantially creates a seal against the walls of the casing string 30. The dart 306 can include one or more sealing portions 320 which extend radially from a body of the cement plug 116. The sealing portions 320 can be operable to create the seal against the casing string 30 and/or the wellbore 22. Accordingly, cement does not pass across the dart 306 as the dart 306 pushes the cement or any other fluid down the casing string 30 and/or the wellbore 22. Also, the dart 306 creating the seal permits the displacement fluid to efficiently and more forcefully push the dart 306 down the casing string 30 and/or the wellbore 22.

The computing device 118, the light source 120, and the lower reel 138 can move downhole with the dart 306. The light source 120 can generate a pulse of light into the fiber optic cable 122. The pulse of light can be transmitted to the receiver at the surface by the fiber optic cable 122.

Once the dart 306 has docked with the cement plug 302, both devices can be forced downhole by displacement fluid injected from the surface until the cement plug 302 and/or dart 306 contact the lower cement plug.

As illustrated in FIGS. 3A-3C, the cement tool 102 can include a tool sensor 350. The tool sensor 350 can be communicatively coupled with the fiber optic cable 122 such that signals from the tool sensor 350 can be received by the computing device 128 via the fiber optic cable 122 during the cementing process. The tool sensor 350 can detect and measure cementing parameters which can provide insight on the progress and structure of the wellbore 22 during cementing. In at least one example, the tool sensor 350 can take measurements during travel down the wellbore 22. In some examples, the tool sensor 350 can take measurements after the cement tool 102 has been seated.

In at least one example, the tool sensor 350 can be coupled to the cement tool 102. In some examples, the tool sensor 350 can be disposed within the cement tool 102 such that the tool sensor 350 is exposed to the environment in the wellbore 22, for example through sample lines. In at least one example, the tool sensor 350 can be powered by a battery. In some examples, the tool sensor 350 can be powered by an electrical converter that converts light from the fiber optic cable 122 to electrical power. In some examples, the tool sensor 350 can be powered by an electrical wireline.

In at least one example, the tool sensor 350 can include a chemical sensor operable to measure one or more chemical properties during the cementing process. For example, the chemical sensor can measure gas influx and/or water influx. Gas can include a hydrocarbon such as methane, ethane, propane, butane, etc. and/or carbon dioxide (CO2). In at least one example, the chemical sensor can measure methane influx which can present problems during the cementing process. Methane influx can present problems during cementing, so detection of methane influx allows for the safe and profitable construction of the wellbore 22. The chemical properties can also include pH, fluid viscosity, relative oil-water-gas fraction(s), hydrocarbon species, aqueous salts/minerals. A dedicated log run is not needed then which can be expensive and involves downtime on a wellbore 22. Additionally, a well log involves physical risks and, with the cementing device disclosed herein, the wellbore 22 does not have to be opened to insert a well logging tool.

In at least one example, the tool sensor 350 can include a cement sensor operable to determine presence of cement 14 at the cement sensor. Detection of cement 14 by the cement sensor can indicate the presence of cement 14 in undesired places. For example, as the cement tool 102 is moved down the wellbore 22 by displacement fluid, the seal created by the sealing portions 320 are supposed to prevent cement from intermingling with the displacement fluid. With an adequate seal, the displacement fluid can more efficiently and effectively push the cement tool 102 down the wellbore. The cement sensor detecting cement 14 uphole of the sealing portions 320 where only displacement fluid is desired indicates an ineffective seal. In at least one example, the cement sensor is positioned on the rear of the cement tool 102 uphole of the sealing portions 320 where only displacement fluid should be present. For example, the cement sensor can be positioned adjacent to the fiber optic cable 122. In some examples, the cement sensor can be positioned within the cement tool 102, and a sample line from the rear of the cement tool 102 provides sampling of the fluid. Accordingly, the cement sensor provides the ability to monitor the effectiveness of the cement tool 102 to hydraulically displace cement 14 and wipe the walls of the wellbore 22 of cement 14 during travel down the wellbore 22 during the cementing process. Knowledge of the effectiveness of the cement tool 102 allows for the safe and profitable construction of the wellbore 22. A dedicated log run is not needed then which can be expensive and involves downtime on a wellbore 22. Additionally, a well log involves physical risks and, with the cementing device disclosed herein, the wellbore 22 does not have to be opened to insert a well logging tool.

In at least one example, one or more additional sensors 312 can be coupled to the fiber optic cable 122 for monitoring one or more conditions within the wellbore 22. In some examples, the additional sensor can include a temperature sensor, an acoustic sensor, a sheer sensor, a pressure sensor, an accelerometer, a chemical sensor, and/or other suitable sensors. The additional sensor 312 can monitor one or more conditions within the wellbore 22 and transmit information regarding the condition to the receiver via the fiber optic cable 122. In some examples, the receiver can include a transmitter for transmitting commands to the additional sensor 312 via the fiber optic cable 122.

As shown in FIGS. 3A-3C, one or more external sensors 300 can be disposed inside and/or outside of the wellbore 22. The external sensors 300 are operable to measure parameters of the wellbore 22 and/or the cementing process. For example, external sensors 300 can include temperature sensors, pressure sensors, chemical sensors, electric field sensors, magnetic field sensors, strain sensors, acoustic sensors, vibration sensors, and/or ionizing radiation sensors.

In some examples, the external sensors 300 can include permanently installed sensors, and sensors may include, for example, fiber optic cables cemented in place in the annular space between the casing and formation. The fiber optic cables may be clamped to the outside of the casing during the deployment, and protected by centralizers and cross coupling clamps. Other types of permanent sensors may include surface and down-hole pressure sensors, where the pressure sensors may be capable of collecting data at rates up to 2,000 Hz or even higher.

The fiber optic cables may house one or several optical fibers and the optical fibers may be single mode fibers, multi mode fibers or a combination of single mode and multi mode optical fibers. The fiber optic sensing systems connected to the optical fibers may include Distributed Temperature Sensing (DTS) systems, Distributed Acoustic Sensing (DAS) Systems, Distributed Strain Sensing (DSS) Systems, quasi-distributed sensing systems where multiple single point sensors are distributed along an optical fiber/cable, or single point sensing systems where the sensors are located at the end of the cable.

The fiber optic sensing systems may operate using various sensing principles including but not limited to amplitude based sensing systems like e.g. DTS systems based on Raman scattering, phase sensing based systems like e.g. DAS systems based on interferometric sensing using e.g. homodyne or heterodyne techniques where the system may sense phase or intensity changes due to constructive or destructive interference, strain sensing systems like DSS using dynamic strain measurements based on interferometric sensors or static strain sensing measurements using e.g. Brillouin scattering, quasi-distributed sensors based on e.g. Fiber Bragg Gratings (FBGs) where a wavelength shift is detected or multiple FBGs are used to form Fabry-Perot type interferometric sensors for phase or intensity based sensing, or single point fiber optic sensors based on Fabry-Perot or FBG or intensity based sensors.

In some examples, the external sensors 300 can include electrical sensors. For example, pressure sensors based on quarts type sensors or strain gauge based sensors or other commonly used sensing technologies. Pressure sensors, optical or electrical, may be housed in dedicated gauge mandrels or attached outside the casing in various configurations for down-hole deployment or deployed conventionally at the surface well head or flow lines.

Various hybrid approached where single point or quasi-distributed or distributed fiber optic sensors are mixed with e.g. electrical sensors are also anticipated. The fiber optic cable may then include optical fiber and electrical conductors.

Temperature measurements from e.g. a DTS system may be used to determine locations for fluid inflow in the treatment well as the fluids from the surface are likely to be cooler than formation temperatures. It is known in the industry to use DTS warm-back analyses to determine fluid volume placement, this is often done for water injection wells and the same technique can be used for fracturing fluid placement. Temperature measurements in observation wells can be used to determine fluid communication between the treatment well and observation well, or to determine formation fluid movement.

DAS data can be used to determine fluid allocation in real-time as acoustic noise is generated when fluid flows through the casing and/or through perforations into the formation. Phase and intensity based interferometric sensing systems are sensitive to temperature and mechanical as well as acoustically induced vibrations. DAS data can be converted from time series date to frequency domain data using Fast Fourier Transforms (FFT) and other transforms like wavelet transforms may also be used to generate different representations of the data. Various frequency ranges can be used for different purposes and where e.g. low frequency signal changes may be attributed to formation strain changes or fluid movement and other frequency ranges may be indicative if fluid or gas movement. Various filtering techniques may be applied to generate indicators of events than may be of interest. Indicators may include formation movement due to growing natural fractures, formation stress changes during the fracturing operations and this effect may also be called stress shadowing, fluid seepage during the fracturing operation as formation movement may force fluid into and observation well and this may be detected, fluid flow from fractures, fluid and proppant flow from frac hits. Each indicator may have a characteristic signature in terms of frequency content and/or amplitude and/or time dependent behavior, and these indicators may be. These indicators may also be present at other data types and not limited to DAS data.

DAS systems can also be used to detect various seismic events where stress fields and/or growing fracture networks generate microseimic events or where perforation charge events may be used to determine travel time between horizontal wells and this information can be used from stage to stage to determine changes in travel time as the formation is fractured and filled with fluid and proppant. The DAS systems may also be used with surface seismic sources to generate vertical seismic profiles before, during and after a fracturing job to determine the effectiveness of the fracturing job as well as determine production effectiveness.

DSS data can be generated using various approaches and static strain data can be used to determine absolute strain changes over time. Static strain data is often measured using Brillouin based systems or quasi-distributed strain data from FBG based system. Static strain may also be used to determine propped fracture volume by looking at deviations in strain data from a measured strain baseline before fracturing a stage. It may also be possible to determine formation properties like permeability, poroelastic responses and leak off rates based on the change of strain vs time and the rate at which the strain changes over time. Dynamic strain data can be used in real-time to detect fracture growth through an appropriate inversion model, and appropriate actions like dynamic changes to fluid flow rates in the treatment well, addition of diverters or chemicals into the fracturing fluid or changes to proppant concentrations or types can then be used to mitigate detrimental effects.

The external sensors 300 may also use Fiber Bragg Grating based systems for a number of different measurements. FBG's are partial reflectors that can be used as temperature and strain sensors, or can be used to make various interferometric sensors with very high sensitivity. FBG's can be used to make point sensors or quasi-distributed sensors where these FBG based sensors can be used independently or with other types of fiber optic based sensors. FBG's can manufactured into an optical fiber at a specific wavelength, and other system like DAS, DSS or DTS systems may operate at different wavelengths in the same fiber and measure different parameters simultaneously as the FBG based systems using Wavelength Division Multiplexing (WDM).

The sensors can be placed in either the treatment well or monitoring well(s) to measure well communication. The treatment well pressure, rate, cement composition, proppant concentration, diverters, fluids and chemicals may be altered to change the cementing process. These changes may impact the formation responses in several different ways like e.g.:

stress fields may change, and this may generate microseismic effects that can be measured with DAS systems and/or single point seismic sensors like geophones the cementing process can generate changes in measured microseismic events and event distributions over time, or changes in measured strain using the low frequency portion or the DAS signal or Brillouin based sensing systems pressure changes due to poroelastic effects may be measured in the monitoring well pressure data may be measured in the treatment well and correlated to formation responses various changes in treatment rates and pressure may generate events that can be correlated to the cementing process.

Several measurements can be combined to determine adjacent well communication, and this information can be used to change the cementing process to generate desired outcomes.

Figure 5:
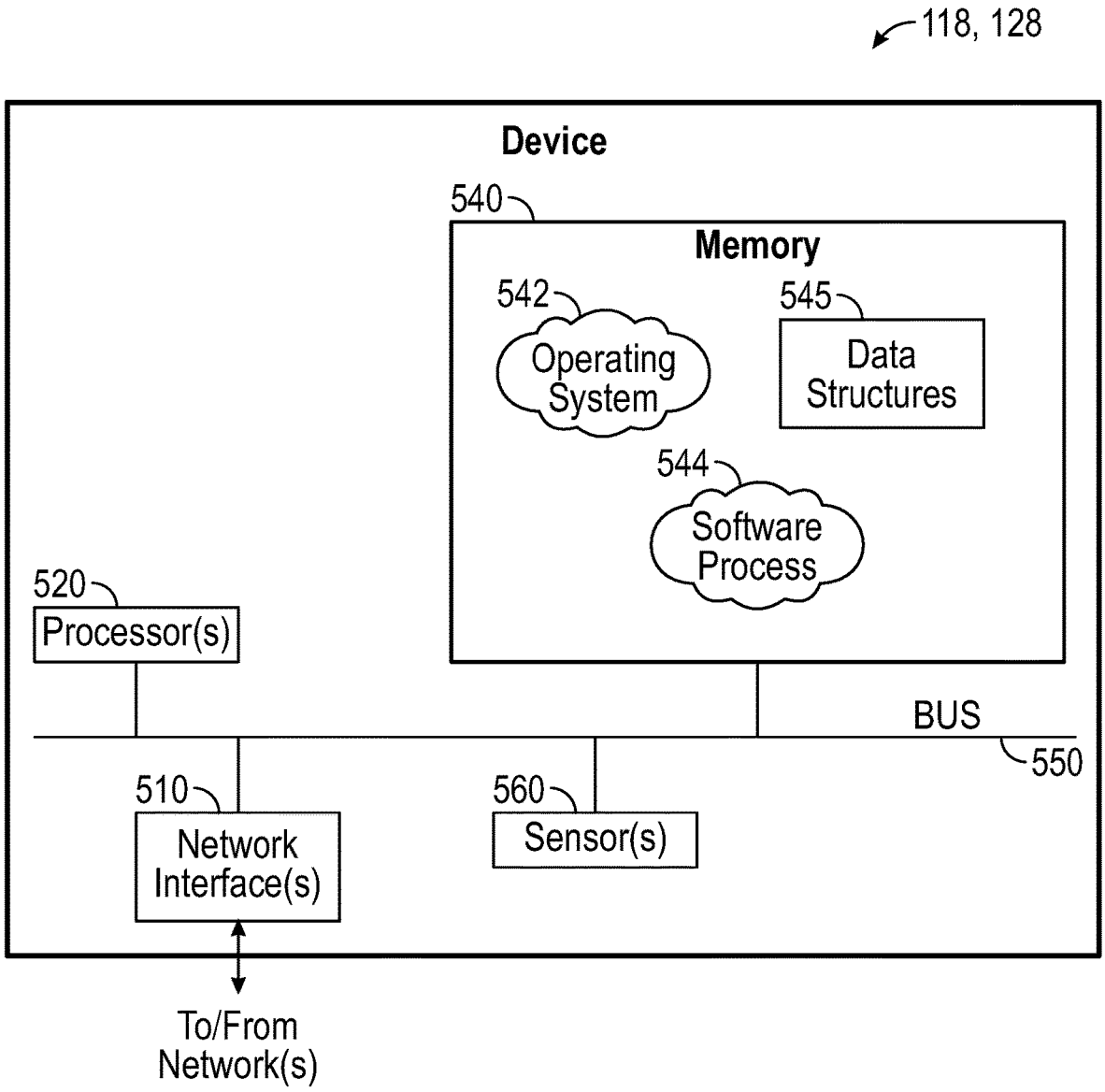
FIG. 5 illustrates a diagram of a computing device which may be employed as shown in FIGS. 3A-3C.

FIG. 5 is a block diagram of an exemplary computing device 118, 128. Computing device 118, 128 is configured to perform processing of data and communicate with the sensors and/or optical signals sent and/or received via a fiber optic cable 122, for example as illustrated in FIGS. 3A-3C. In operation, computing device 118, 128 communicates with one or more of the above-discussed components and may also be configured to communication with remote devices/systems.

As shown, computing device 118, 128 includes hardware and software components such as network interfaces 510, at least one processor 520, sensors 560 and a memory 540 interconnected by a system bus 550. Network interface(s) 510 can include mechanical, electrical, and signaling circuitry for communicating data over communication links, which may include wired or wireless communication links. Network interfaces 510 are configured to transmit and/or receive data using any variety of different communication protocols.

Processor 520 represents a digital signal processor (e.g., a microprocessor, a microcontroller, or a fixed-logic processor, etc.) configured to execute instructions or logic to perform tasks in a wellbore environment. Processor 520 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 520 typically operates in conjunction with shared or dedicated hardware, including but not limited to, hardware capable of executing software and hardware. For example, processor 520 may include elements or logic adapted to execute software programs and manipulate data structures 545, which may reside in memory 540.

Sensors 560, which may include sensors 300 as disclosed herein, typically operate in conjunction with processor 520 to perform measurements, and can include special-purpose processors, detectors, transmitters, receivers, and the like. In this fashion, sensors 560 may include hardware/software for generating, transmitting, receiving, detection, logging, and/or sampling magnetic fields, seismic activity, and/or acoustic waves, or other parameters.

Memory 540 comprises a plurality of storage locations that are addressable by processor 520 for storing software programs and data structures 545 associated with the examples described herein. An operating system 542, portions of which may be typically resident in memory 540 and executed by processor 520, functionally organizes the device by, inter alia, invoking operations in support of software processes and/or services 544 executing on computing device 118, 128. These software processes and/or services 544 may perform processing of data and communication with computing device 118, 128, as described herein. Note that while process/service 544 is shown in centralized memory 540, some examples provide for these processes/services to be operated in a distributed computing network.

Other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 544 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 520 or computer readable medium encoded with instructions for execution by processor 520 that, when executed by the processor, are operable to cause the processor to perform the functions described herein.

Figure 6:
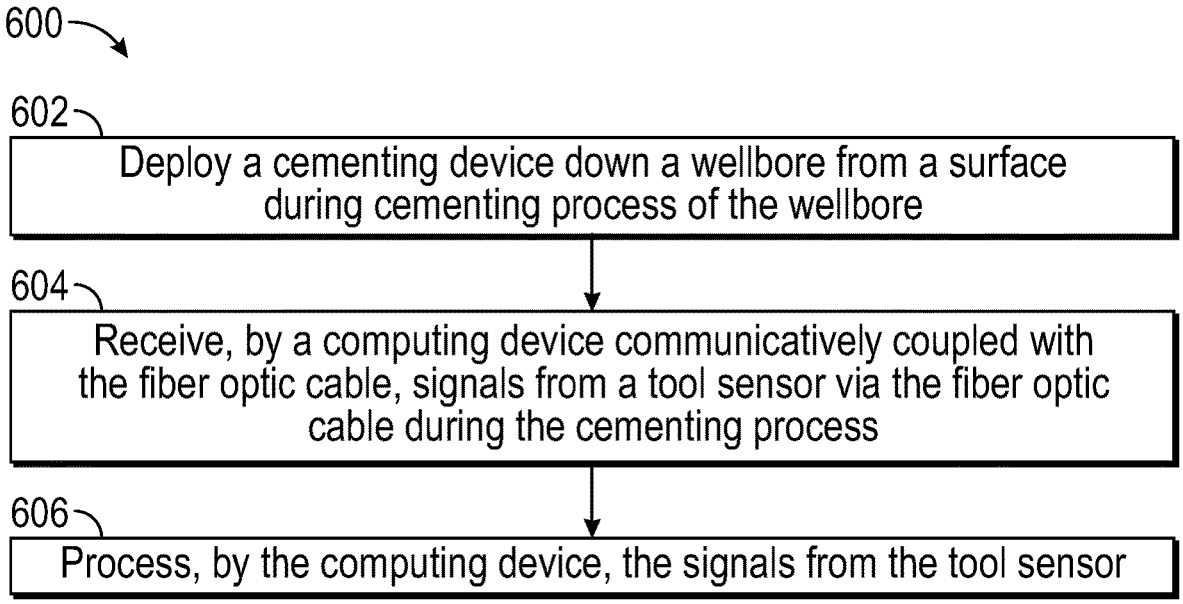
FIG. 6 is a flow chart of a method for generating a model of properties and identification of deposits.

Referring to FIG. 6, a flowchart is presented in accordance with an example embodiment. The method 600 is provided by way of example, as there are a variety of ways to carry out the method. The method 600 described below can be carried out using the configurations illustrated in FIG. 1-5, for example, and various elements of these figures are referenced in explaining example method 600. Each block shown in FIG. 6 represents one or more processes, methods or subroutines, carried out in the example method 600. Furthermore, the illustrated order of blocks is illustrative only and the order of the blocks can change according to the present disclosure. Additional blocks may be added or fewer blocks may be utilized, without departing from this disclosure. The example method 600 can begin at block 602.

At block 602, a cementing device is deployed down a wellbore from a surface during cementing process of the wellbore. The cementing device includes a cement tool and a fiber optic cable coupled with the cement tool. In at least one example, the cement tool can include a cement plug and/or a dart operable to be received by a lower cement plug disposed in the wellbore. The cement tool can be deployed into the wellbore by injecting displacement fluid into the wellbore from the surface. As the cement tool is deployed down the wellbore, for example through a casing string, the fiber optic cable is dispensed such that the fiber optic cable spans the wellbore from the cement tool to the surface.

The cement tool can include a tool sensor. The fiber optic cable can be communicatively coupled with the tool sensor.

In at least one example, the tool sensor can include a chemical sensor. The chemical sensor can measure one or more chemical properties during the cementing process. In at least one example, the chemical properties can include methane influx.

In at least one example, the tool sensor can include a cement sensor. The cement sensor can determine presence of cement at the cement sensor. In some examples, the cement tool can include one or more sealing portions extending radially from a body of the cement tool. The sealing portions can be operable to create a seal against the casing string. The cement sensor can be operable to determine the presence of cement uphole of the sealing portions. In at least one example, the cement sensor can be positioned uphole of the sealing portions.

At block 604, a computing device communicatively coupled with the fiber optic cable receives signals from the tool sensor via the fiber optic cable during the cementing process. In at least one example, the computing device can be disposed at the surface. In some examples, the computing device can be disposed in the wellbore. At block 606, the computing device processes the signals from the fiber optic cable. Based on the signals received from the tool sensor, the cementing process can be adjusted as needed. For example, more cement may be pumped down the wellbore, and/or the cementing process may be paused.

As the fiber optic cable is disposed either in the wellbore and/or in a casing string, the measurements taken during the cementing process can be conducted and processed at the surface with less complexity and less cost than conventional sensors disposed outside of the wellbore.

Numerous examples are provided herein to enhance understanding of the present disclosure. A specific set of statements are provided as follows.

Statement 1: A system is disclosed for cementing a wellbore having a casing string disposed in the wellbore, the system comprising: a cement tool operable to be deployed down the wellbore through a casing string from a surface during cementing process of the wellbore, the cement tool including a tool sensor; a fiber optic cable coupled with the cement tool such that the fiber optic cable spans the wellbore from the cement tool to the surface, the fiber optic cable being communicatively coupled with the tool sensor; and a computing device communicatively coupled with the fiber optic cable, the computing device operable to receive and process signals from the tool sensor via the fiber optic cable during the cementing process.

Statement 2: A system is disclosed according to Statement 1, wherein the tool sensor includes a chemical sensor operable to measure one or more chemical properties during the cementing process.

Statement 3: A system is disclosed according to Statement 2, wherein the one or more chemical properties include gas influx and/or water influx.

Statement 4: A system is disclosed according to any of preceding Statements 1-3, wherein the tool sensor includes a cement sensor operable to determine presence of cement.

Statement 5: A system is disclosed according to Statement 4, wherein the cement tool includes one or more sealing portions extending radially from a body of the cement tool operable to create a seal against the casing string, wherein the cement sensor determines the presence of cement uphole of the sealing portions.

Statement 6: A system is disclosed according to any of preceding Statements 1-5, wherein the cement tool includes a cement plug and/or a dart operable to be received by a lower cement plug disposed in the wellbore.

Statement 7: A system is disclosed according to any of preceding Statements 1-6, wherein the cement tool is deployed down the wellbore by injection of displacement fluid from the surface.

Statement 8: A cementing device is disclosed comprising: a cement tool operable to be deployed down the wellbore through the casing string from a surface during cementing process of the wellbore, the cement tool including a tool sensor; and a fiber optic cable coupled with the cement tool such that the fiber optic cable spans the wellbore from the cement tool to the surface, the fiber optic cable being communicatively coupled with the tool sensor.

Statement 9: A cementing device is disclosed according to Statement 8, wherein the tool sensor includes a chemical sensor operable to measure one or more chemical properties during the cementing process.

Statement 10: A cementing device is disclosed according to Statement 9, wherein the one or more chemical properties include gas influx and/or water influx.

Statement 11: A cementing device is disclosed according to any of preceding Statements 8-10, wherein the tool sensor includes a cement sensor operable to determine presence of cement.

Statement 12: A cementing device is disclosed according to Statement 11, wherein the cement tool includes one or more sealing portions extending radially from a body of the cement tool operable to create a seal against the casing string, wherein the cement sensor determines the presence of cement uphole of the sealing portions.

Statement 13: A cementing device is disclosed according to any of preceding Statements 8-12, wherein the cement tool includes a cement plug and/or a dart operable to be received by a lower cement plug disposed in the wellbore.

Statement 14: A cementing device is disclosed according to any of preceding Statements 8-13, wherein the cement tool is deployed down the wellbore by injection of displacement fluid from the surface.

Statement 15: A cementing device is disclosed according to any of preceding Statements 8-14, wherein the fiber optic cable is communicatively coupled with a computing device which is operable to receive and process signals from the fiber optic cable.

Statement 16: A method is disclosed comprising: deploying a cementing device down a wellbore from a surface during cementing process of the wellbore, the cementing device including: a cement tool including a tool sensor; and a fiber optic cable coupled with the cement tool such that the fiber optic cable spans the wellbore from the cement tool to the surface, the fiber optic cable being communicatively coupled with the tool sensor; receiving, by a computing device communicatively coupled with the fiber optic cable, signals from the tool sensor via the fiber optic cable during the cementing process; and processing, by the computing device, the signals from the tool sensor.

Statement 17: A method is disclosed according to Statement 16, wherein the tool sensor includes a chemical sensor, the method further comprising: measuring, by the chemical sensor, one or more chemical properties during the cementing process.

Statement 18: A method is disclosed according to Statements 16 or 17, wherein the cement tool includes a cement plug and/or a dart operable to be received by a lower cement plug disposed in the wellbore, the method further comprising: injecting displacement fluid into the wellbore from the surface to deploy the cement tool.

Statement 19: A method is disclosed according to any of preceding Statements 16-18, wherein the tool sensor includes a cement sensor, the method further comprising: determining, by the cement sensor, presence of cement.

Statement 20: A method is disclosed according to Statement 19, wherein the cement tool includes one or more sealing portions extending radially from a body of the cement tool operable to create a seal against the casing string, wherein the cement sensor determines the presence of cement uphole of the sealing portions.

The disclosures shown and described above are only examples. Even though numerous properties and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

The invention claimed is:

1. A system for cementing a wellbore having a casing string disposed in the wellbore, the system comprising:

a cement tool operable to be deployed down the wellbore through a casing string from a surface during cementing process of the wellbore, the cement tool including a tool sensor, wherein the tool sensor includes a cement sensor operable to determine presence of cement, wherein the cement tool includes one or more sealing portions extending radially from a body of the cement tool operable to create a seal against the casing string, wherein the cement sensor determines the presence of cement uphole of the sealing portions;

a fiber optic cable coupled with the cement tool such that the fiber optic cable spans the wellbore from the cement tool to the surface, the fiber optic cable being communicatively coupled with the tool sensor; and a computing device communicatively coupled with the fiber optic cable, the computing device operable to receive and process signals from the tool sensor via the fiber optic cable during the cementing process.

2. The system of claim 1, wherein the tool sensor includes a chemical sensor operable to measure one or more chemical properties during the cementing process.

3. The system of claim 2, wherein the one or more chemical properties include gas influx and/or water influx.

4. The system of claim 1, wherein the cement tool includes a cement plug and/or a dart operable to be received by a lower cement plug disposed in the wellbore.

5. The system of claim 1, wherein the cement tool is deployed down the wellbore by injection of displacement fluid from the surface.

6. A cementing device comprising:

a cement tool operable to be deployed down the wellbore through the casing string from a surface during cementing process of the wellbore, the cement tool including a tool sensor, wherein the tool sensor includes a cement sensor operable to determine presence of cement, wherein the cement tool includes one or more sealing portions extending radially from a body of the cement tool operable to create a seal against the casing string, wherein the cement sensor determines the presence of cement uphole of the sealing portions; and a fiber optic cable coupled with the cement tool such that the fiber optic cable spans the wellbore from the cement tool to the surface, the fiber optic cable being communicatively coupled with the tool sensor.

7. The cementing device of claim 6, wherein the tool sensor includes a chemical sensor operable to measure one or more chemical properties during the cementing process.

8. The cementing device of claim 7, wherein the one or more chemical properties include gas influx and/or water influx.

9. The cementing device of claim 6, wherein the cement tool includes a cement plug and/or a dart operable to be received by a lower cement plug disposed in the wellbore.

10. The cementing device of claim 6, wherein the cement tool is deployed down the wellbore by injection of displacement fluid from the surface.

11. The cementing device of claim 6, wherein the fiber optic cable is communicatively coupled with a computing device which is operable to receive and process signals from the fiber optic cable.

12. A method comprising:

deploying a cementing device down a wellbore from a surface during cementing process of the wellbore, the cementing device including:

a cement tool including a tool sensor, wherein the tool sensor includes a cement sensor, wherein the cement tool includes one or more sealing portions extending radially from a body of the cement tool operable to create a seal against the casing string; and a fiber optic cable coupled with the cement tool such that the fiber optic cable spans the wellbore from the cement tool to the surface, the fiber optic cable being communicatively coupled with the tool sensor;

receiving, by a computing device communicatively coupled with the fiber optic cable, signals from the tool sensor via the fiber optic cable during the cementing process;

processing, by the computing device, the signals from the tool sensor; determining, by the cement sensor, presence of cement uphole of the sealing portions.

13. The method of claim 12, wherein the tool sensor includes a chemical sensor, the method further comprising:

measuring, by the chemical sensor, one or more chemical properties during the cementing process.

14. The method of claim 12, wherein the cement tool includes a cement plug and/or a dart operable to be received by a lower cement plug disposed in the wellbore, the method further comprising:

injecting displacement fluid into the wellbore from the surface to deploy the cement tool.

* * * * *